US005402945A

United States Patent [19]

Swanson, Jr.

[11] Patent Number: 5,402,945

[45] Date of Patent: Apr. 4, 1995

[54] METHOD FOR SPRAYING PLANTS AND APPARATUS FOR ITS PRACTICE

[75] Inventor: Wallace A. Swanson, Jr., Modesto, Calif.

[73] Assignee: Gervan Company International, Modesto, Calif.

[21] Appl. No.: 7,573

[22] Filed: Jan. 22, 1993

[51] Int. Cl.[6] ..... B05B 5/02; B05B 7/00; B05B 1/28

[52] U.S. Cl. ..... 239/706; 239/3; 239/8; 239/77; 239/695; 239/290; 239/296; 239/288.3; 239/166; 239/434; 239/172

[58] Field of Search ..... 239/3, 8, 11, 77, 706, 239/690, 695, 290, 296, 288, 288.3, 434, 166, 172, 159, 163

[56] References Cited

U.S. PATENT DOCUMENTS

| | | | |
|---|---|---|---|
| 3,339,840 | 9/1967 | Point | 239/695 |
| 3,344,992 | 10/1967 | Norris | 239/290 |
| 3,770,209 | 11/1973 | Wilcox | 239/434 |
| 4,504,014 | 3/1985 | Leuning | 239/434 |
| 4,565,318 | 1/1986 | Inculet | 239/3 |
| 4,583,319 | 4/1986 | Wolff et al. | 239/8 |
| 4,673,132 | 6/1987 | Inculet et al. | 239/77 |
| 4,703,891 | 11/1987 | Jackson et al. | 239/695 |
| 4,749,129 | 6/1988 | Hanson | 239/77 |
| 4,762,274 | 8/1988 | Burls et al. | 239/290 |
| 4,765,539 | 8/1988 | Noakes et al. | 239/706 |
| 5,176,322 | 1/1993 | Sartor | 239/77 |

FOREIGN PATENT DOCUMENTS

| | | | |
|---|---|---|---|
| 2201873 | 9/1988 | United Kingdom | 239/695 |

*Primary Examiner*—Andres Kashnikow
*Assistant Examiner*—Christopher G. Trainor
*Attorney, Agent, or Firm*—Brian J. Laurenzo; Kent A. Herink; Brett J. Trout

[57] ABSTRACT

An improved method for row crop spraying whereby a solution is atomized by high speed air, imparted with an electrical charge, slowed with more high speed air, and deposited over crops including a nozzle for practicing such a technique. Such charged droplets are attracted to oppositely charged crops and are, therefore, more likely to adhere to crops than fall to the ground or to be swept away by the wind. Since a larger percentage of solution adheres to the plant, less solution can be applied thereby addressing both environmental and pecuniary concerns.

25 Claims, 4 Drawing Sheets

METHOD FOR SPRAYING PLANTS AND APPARATUS FOR ITS PRACTICE

BACKGROUND OF THE INVENTION

The present invention relates generally to the spraying of plants and, more particularly, to a process of spraying row crops with an atomized, charged, aqueous solution and a nozzle for practicing same.

Although aqueous solutions, such as herbicides, may be applied to crops by several methods including crop dusting and hand application, by far the most common method of application is by an implement secured to a tractor. While relatively simple and adequate for effectively covering crops with a chemical, standard tractor-pulled implements often waste much of the chemical.

The majority of plant spraying involves either aqueous solutions or suspensions in water. A major shortcoming of this method of application is that a substantial portion of the sprayed product is wasted when it lands on the ground or is carried away by the wind.

Not only is the loss of such chemicals costly in a monetary sense, the excess chemical that must be applied to insure adequate crop coverage can often have a devastating impact on the environment. When large amounts of chemicals are applied to crops, the harmful repercussions are felt most quickly by beneficial insects and nearby wildlife. More importantly, heavy application of chemicals sometimes leads to detectable amounts of such chemicals in human drinking water. Since many such chemicals are, by their very nature, highly toxic a decrease in the amount of such chemicals used on crops through more precise application of the chemicals is a highly desirable goal both for the person applying the chemical as well as for the environment as a whole.

Electrostatic sprayers have been used in orchards to spray fruit trees with chemicals such as herbicides and fertilizers. These sprayers impart an electrical charge upon the chemical causing the chemical to be attracted to the plant being sprayed. With a greater percentage of the chemical sticking to the plant, less chemical is used and less is wasted. A problem with this technique is that the charging means imparts a disproportionately greater charge on droplets of chemical passing nearest the charging means and a disproportionately smaller or lack of charge on the droplets of chemical passing furthest from the charging means. Consequently, some droplets are given an unnecessarily strong charge while others are given no charge at all.

Another problem with the electrostatic spraying technique is that an air stream great enough to atomize the chemical propels the chemical so quickly that the resulting mist will often damage crops close to the air/-chemical outlet. This potential crop damage prevents the technique from being applied to row crop spraying which entails placing the air/chemical outlets close to the crops.

The difficulties encountered in the prior art discussed hereinabove are substantially eliminated by the present invention.

SUMMARY OF THE INVENTION

Accordingly, it is an object of the present invention to provide a method for spraying row crops wherein a greater percentage of the spraying solution is deposited directly on the crops.

Another object of the present is to provide a method for spraying an aqueous solution on row crops wherein the solution is attracted to the crops due to the charge on the solution in relationship to the crops.

Yet another object of the present invention is to provide a method for spraying row crops wherein less spraying solution is needed to cover the same amount of crops.

Another object of this invention is to provide a method for spraying row crops with a chemical wherein the crops are not damaged from the air jet used to atomize the chemical.

Still another object of the present invention is to provide a method for spraying row crops wherein safety to the person applying the spraying solution and to the environment are increased through the application of less solution.

A further object of the present invention is to provide an apparatus for spraying row crops which will simultaneously atomize and charge the aqueous solution being applied.

Another object of the present invention is to provide an apparatus for spraying row crops which slows charged atomized particles of solution before the solution is applied to the crops.

These and other objects of the invention will become apparent upon reference to the following specification, drawings and claims.

By the present invention, it is proposed to overcome the difficulties encountered heretofore. To this end, a high speed air stream is provided along with a solution which is to be applied to crops. The high speed air stream is passed into the solution and the solution is atomized into particles. A stream of these particles is passed near an electrical conductor. An electrical charge is imparted to the electrical conductor thereby charging the stream of particles. The stream of particles is then slowed with a cross-jet of high speed air, whereafter the particles are deposited over the crops.

DETAILED DESCRIPTION OF THE INVENTION

Figure 5:
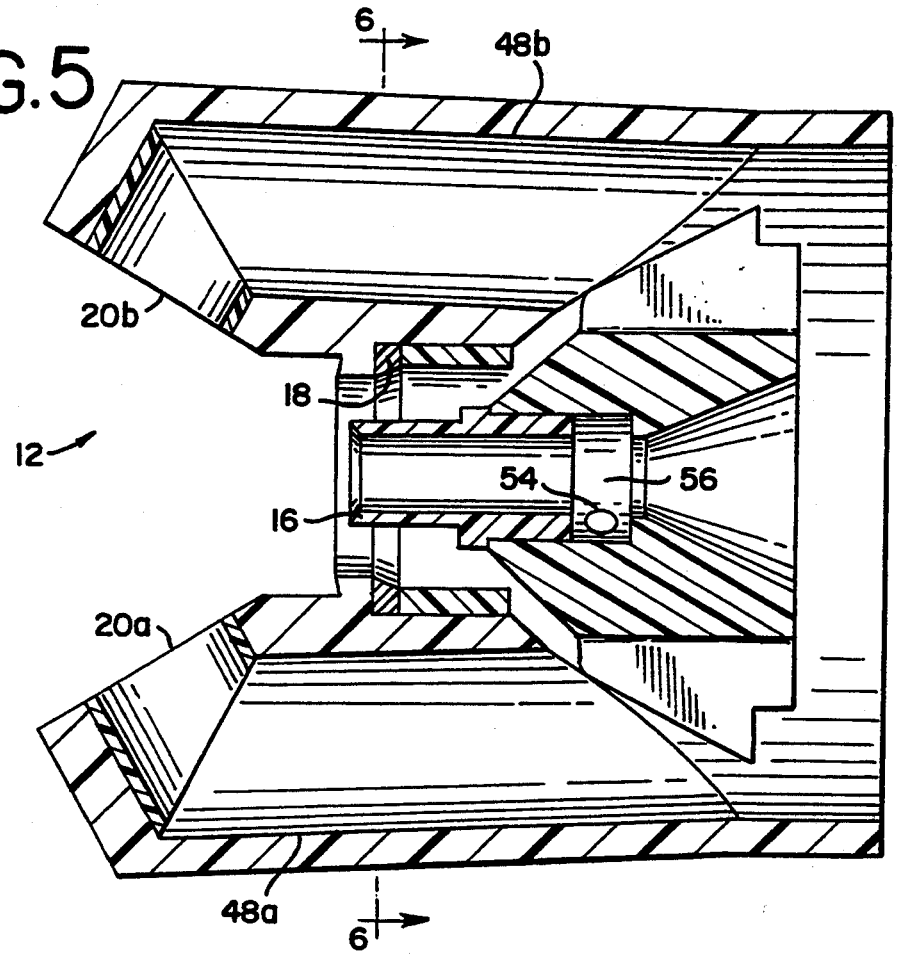
FIG. 5 is a side elevational view of the spray nozzle in cross-section taken along the line 5—5 of FIG. 4, showing further details of the nozzle housing, charged annular conductor, nozzle barrel, and air jet outlets.
Figure 6:
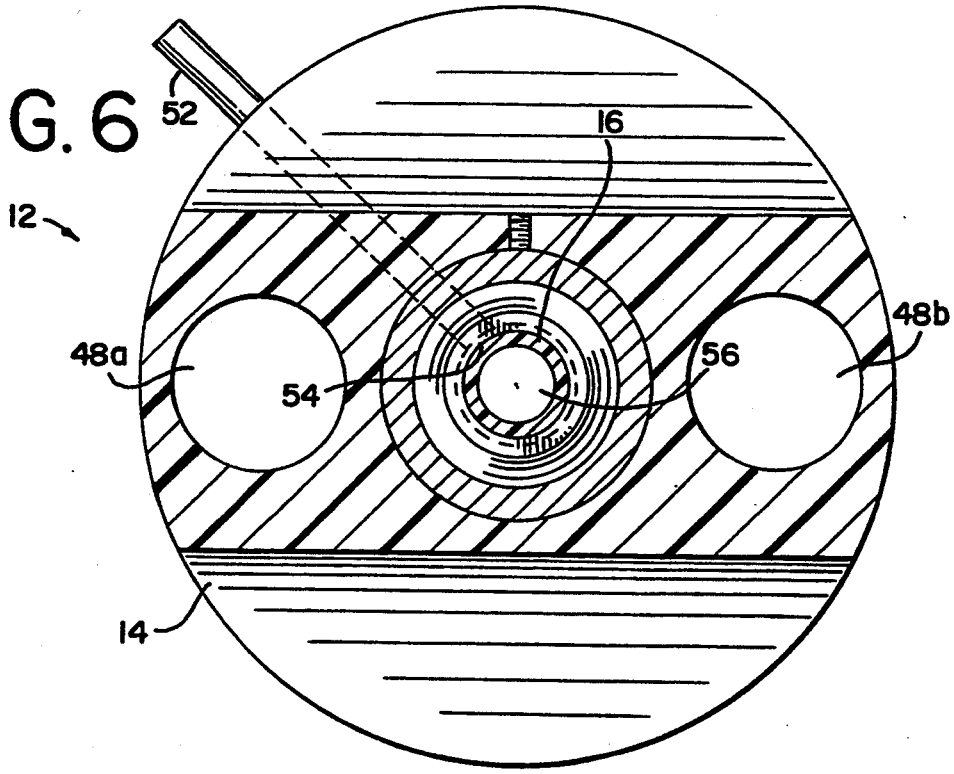
FIG. 6 is a front elevational view of the spray nozzle in cross-section taken along the line 6—6 of FIG. 5.

In the figures, a sprayer comprising a spray nozzle 12, specifically, a spray nozzle 12 which atomizes and charges aqueous solutions for application to row crops 22, is shown generally at 24. In the preferred embodiment, the nozzle 12 comprises a housing 14 of molded thermoplastic resin, an atomization chamber 56 running through the center of the nozzle, and a charged arcuate conductor 18 surrounding a charging barrel 16 (FIG. 5). The conductor 18 charges the solution as it is blown through the charging barrel 16 by high speed air. Two fanning jets 20*a–b* then slow the charged atomized solution and deposit the solution over the crops 22 (FIGS. 1 and 5).

After the fanning jets 20*a–b* slow the charged particles, the charge on the particles causes the particles to float toward and aggregate upon the crops 22 thereby increasing their speed of descent and concomitantly decreasing the chance that the wind will sweep the particles up and away from the crops 22. Although the atomized particles are charged in relationship to the ground as well, the particles are more likely to adhere to the crops 22, rather than the ground, because most particles attach to the crops 22 before they get close enough to be attracted to the ground.

Figure 1:
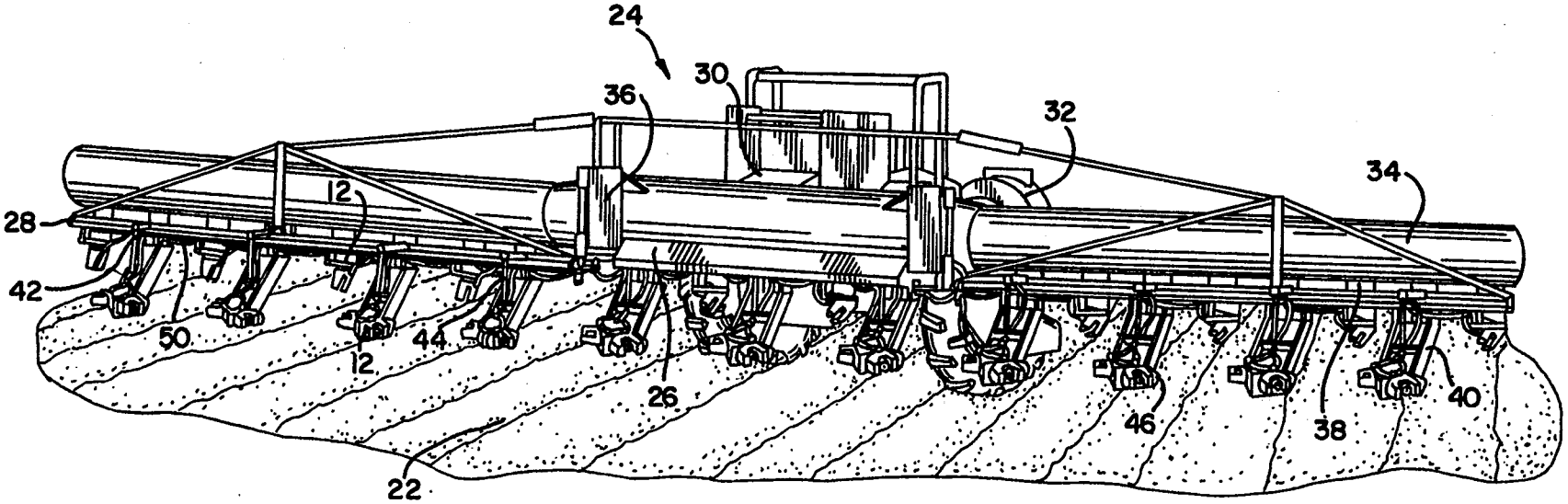
FIG. 1 is a perspective view of a sprayer, constructed in accordance with this invention, shown secured for operation behind a tractor.

In the row crop spraying of an atomized aqueous solution on crops 22, a sprayer 24 is provided, mounted on a tractor and consisting of a main frame section 26 and two secondary frame sections 28 (FIG. 1). Mounted on the main frame section 26 is a high pressure centrifugal fan 30, an aqueous solution reservoir tank 32, a plenum chamber 34, and several nozzles 12 through which the aqueous solution is applied to the crops 22.

In the preferred embodiment of the present invention, the secondary frames 28 are attached to the main frame 26 by means of a hinge assembly 36 which allows the secondary frame sections 28, which extend beyond the transverse width of the tractor, to be folded back against the sides of the tractor for storage and transport. These secondary frame sections 28 support the remaining length of the plenum chamber 34. The secondary frame sections 28 also have several nozzles 12 extending therefrom to extend the coverage of the apparatus.

In the preferred embodiment the high pressure centrifugal fan 30 generates an air flow approaching two-hundred miles per hour. This air flow is directed into a plenum means mounted on the main frame 26 and the secondary frames 28. In the preferred embodiment the plenum means is the plenum chamber 34 which is of a hollow cylindrical configuration and is constructed of a flexible air impermeable material such as plastic canvas.

As air is pumped from the high pressure centrifugal fan 30 into the plenum chamber 34, the chamber 34 inflates and distributes the air flow evenly among several nozzle outlets 38 which depend from the main 26 and secondary 28 frame sections. The spray nozzles 12 are connected to the nozzle outlets 38 either directly or indirectly through an extension means. In the preferred embodiment the extension means are a series of extension arms 40 depending from the frame sections 26 and 28. These extension arms 40 position the nozzles 12 closer to the ground to more efficiently cover low growing crops 22 such as broccoli or cabbage. The extension arms 40 are mounted to the frame sections 26 and 28 by means of a hinge 42 which allows the extension arms 40 to raise up as they pass over stumps, rocks, and other obstacles. A spring 44 connects the extension arms 40 to the frame sections 26 and 28 to prevent damage to the arms 40 and nozzles 12 as the arms 40 swing back into place after clearing an obstacle.

In the preferred embodiment two nozzles 12 are attached to the end of each extension arm 40. Attached to each extension arm 40 behind each nozzle 12 is a shielding means which protects the nozzle 12 from rocks or other debris which may pass the side of the extension arm 28 close enough to damage the nozzle 12. In the preferred embodiment the shielding means is in the form of steel guard plates 46 mounted to the extension arms 40 behind the nozzles 12.

Upon reaching a particular nozzle 12, the high speed air is vented in two directions (FIG. 5). Some of the air is directed through an atomization means while the rest of the air is directed around the atomization means. In the preferred embodiment the atomization means is an atomization chamber 56. The air directed around the atomization chamber 56 is quickly divided again. Most of the air going around the chamber 56 is directed into one of two cylindrical fanning barrels 48*a–b*. The rest of the air directed around the atomization chamber 56 is directed through the charged arcuate conductor 18 and then back into the path of the effluence from the atomization chamber 56. This air directed around the atomization chamber 56 and through the arcuate conductor 18 keeps the chamber effluent from adhering to either the arcuate conductor 18 or the spray nozzle 12 itself.

Figures 2, 7:
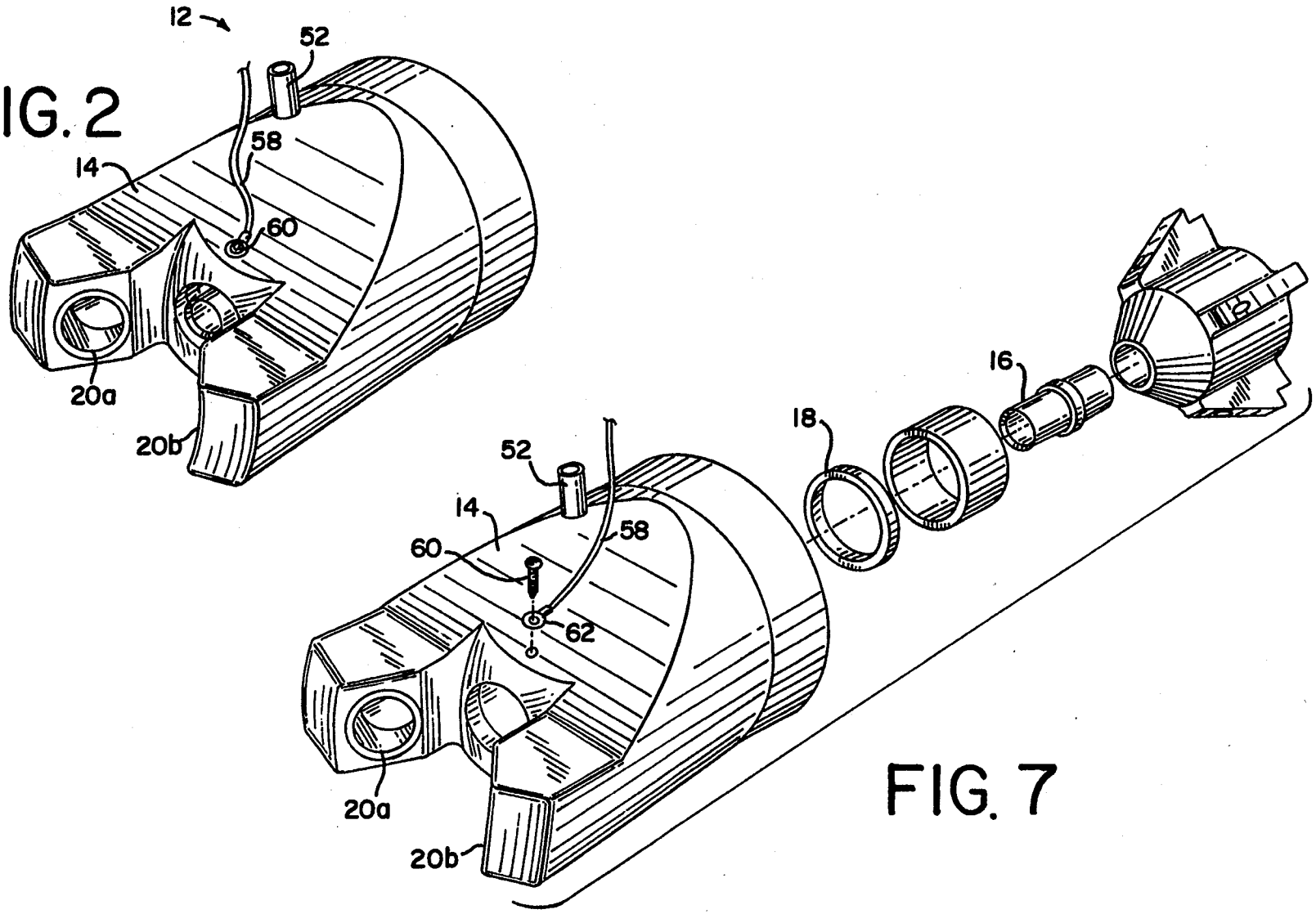
FIG. 2 is a perspective view of a spray nozzle component of the sprayer shown in FIG. 1.
FIG. 7 is an exploded view of the spray nozzle shown in FIG. 2.
Figure 4:
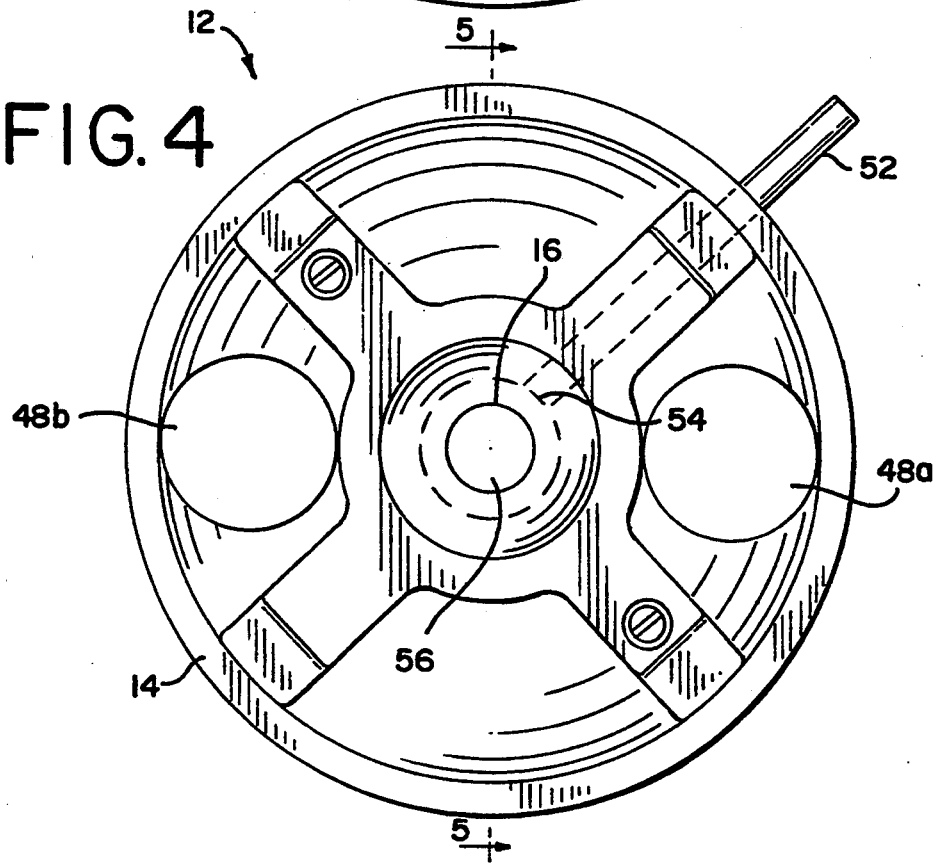
FIG. 4 is a rear elevational view of the spray nozzle shown in FIG. 2.

In the preferred embodiment the material which is to be sprayed on the crops is stored in an aqueous solution reservoir tank 32 mounted on the tractor (FIG. 1). The aqueous solution is gravity fed through a series of hoses 50 to each spray nozzle 12. The hoses 50 feed into an aqueous solution inlet 52 mounted on the side of the spray nozzle 12 (FIGS. 1 and 2). The aqueous solution passes through the inlet 52 to the aqueous solution outlet 54 which opens into the atomization chamber 56 (FIG. 4). As the high speed air passes through the atomization chamber 56, it creates a low pressure venturi which draws the aqueous solution from the solution outlet 54 into the atomization chamber 56. The outlet 54 is positioned so that the solution enters the atomization chamber 56 substantially perpendicular to the direction of the passing air stream. As the solution leaves the chamber 56, the high speed air shears the solution into tiny droplets which become charged at the outlet of the venturi by the charging means.

In the preferred embodiment the charging means consists of a charging barrel 16, an arcuate conductor 18, a wire 58, a conductive screw 60, and a ring terminal 62 (FIG. 7). The arcuate conductor 18 is charged by the wire 58 which carries 15,000 volts of electricity coming from a rectifier which steps up the standard 12 volt charge coming from the tractor's battery. The wire 58 is attached to the spray nozzle's thermoplastic housing 14 at a point over the charged arcuate conductor 18 by means of the conductive screw 60. The wire 58 is connected to the screw 60 by the ring terminal 62 but may, of course, be connected by any means which maintains conductivity between the wire 58 and screw 60. The screw 60 is screwed into the thermoplastic housing 14 until it is in conductive contact with the charged arcuate conductor 18. In the preferred embodiment and in the figures the charged arcuate conductor 18 is of an annular design but may, of course, be of any arcuate construction. In the preferred embodiment, the charge imparted upon the charged annular conductor 18 is 15,000 volts of direct current at ½ amp.

As the high speed air carries the tiny droplets of atomized solution through the charging barrel 16, the current running through the charged arcuate conductor 18 imparts a charge upon the droplets relative to the ground and the crops 22 being sprayed (FIGS. 1 and 5). The charged droplets are then expelled from the charging barrel 16 toward the crops 22 by the high speed air which carried the charged droplets.

Figure 3:
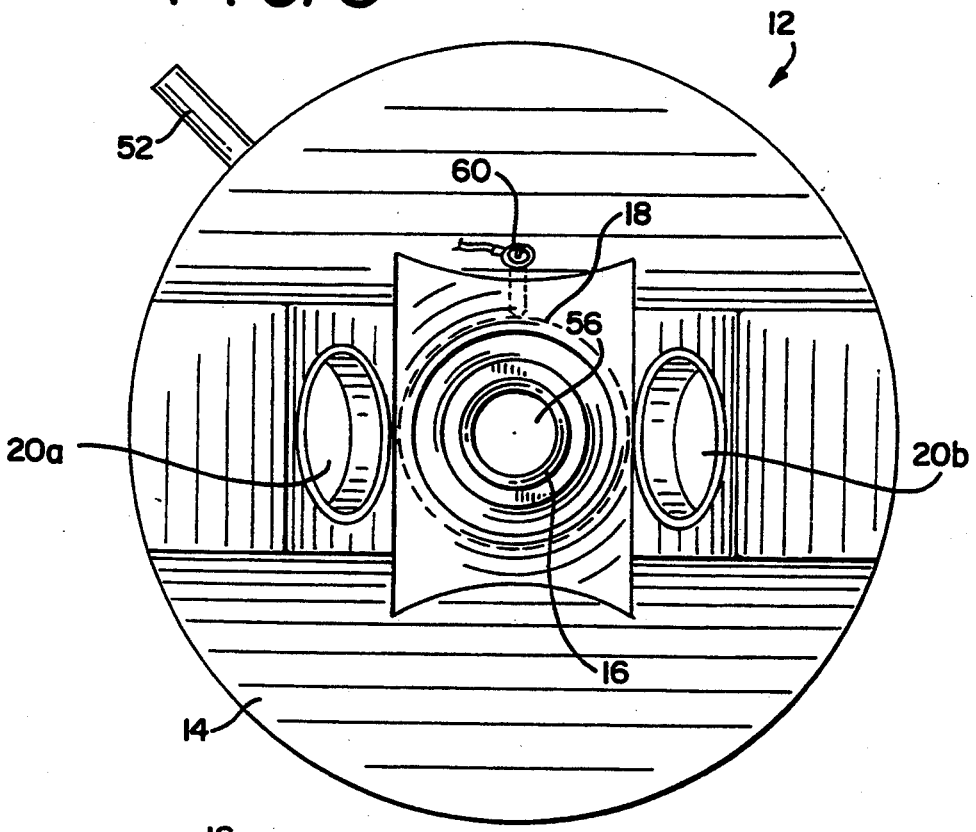
FIG. 3 is a front elevational view of the spray nozzle shown in FIG. 2.

The high speed air passing on the outside of the atomization chamber 56 passes over the inside of the charged arcuate conductor 18 preventing the aqueous solution from directly contacting the conductor 18. This same air also focuses the material exiting the charging barrel 16 to prevent the material from adhering to the nozzle housing 14 (FIG. 3).

The housing 14 of the spray nozzle 12 is molded so that the housing 14 angles the high speed air moving along one of the fanning barrel 48*a* toward one of the cylindrical fanning jets 20*a* (FIGS. 4 and 5). The fanning jet 20*a* is angled toward the high speed stream of material being emitted from the charging barrel 16. A second fanning barrel 48*b* and fanning jet 20*b* are mounted on the opposite side of the spray nozzle 12 to create a cross-jet effect which slows the material being emitted from the charging barrel 16.

The dual fanning jets 20*a–b* not only slow the effluence from the charging barrel 16 but also disperse the effluence over a larger area allowing each nozzle 12 a greater degree of crop coverage (FIGS. 1 and 7). The droplets of aqueous solution are heavier than air, they will move downward in relation to the spray nozzle 12 after being dispersed by the fanning jets 20*a–b*. The droplets are charged in relation to the crops 22 and the ground so the droplets will initially move toward the crops 22 and then toward the ground. Because the crops 22 are higher than the ground, the droplets will be drawn toward the crops 22 before being drawn toward the ground. This leads to a disproportionate number of droplets being deposited on the crops 22 rather than lost on the ground. Furthermore, since the droplets move toward the crops 22, they spend less time in the air, thereby decreasing the chance that the droplets will be blown away by the wind.

The foregoing description and drawings merely explain and illustrate the invention and the invention is not limited thereto, except insofar as the claims are so limited, as those skilled in the art who have the disclosure before them will be able to make modifications and variations therein without departing from the scope of the invention. By way of example, it should be clear that more than two fanning barrels 48 and fanning jets 20 may be used on a single nozzle 12 and that the diameters of the fanning barrels 48 and fanning jets 20 may be varied to adjust for the coverage desired and the distance of the nozzle from the crops. By further example, it is contemplated that multiple aqueous solution inlets 52 may be used to cover crops with several chemicals in a single pass.

I claimed:

1. A process for row-crop spraying of charged atomized solutions over crops, said process comprising the steps of:

(a) providing a high speed air stream;
(b) providing a solution which is to be applied to the crop;
(c) passing said high speed air stream into said solution;
(d) atomizing said solution into particles;
(e) passing a stream of said particles near an electrical conductor;
(f) charging said stream of particles by imparting an electrical charge to said conductor;
(g) slowing said charge stream of particles with a cross-jet of high speed air;
(h) depositing said charge stream of particles over the crops with a nozzle; and
(i) drawing said solution into said nozzle by means of a venturi created by said high speed air stream passing over an inlet for said solution.

2. A process for row crop spraying of charged atomized solutions over crops said process comprising the steps of:

(a) providing a high speed air stream;
(b) providing a solution which is to be applied to the crops;
(c) atomizing said solution by sheering said solution into particles with said high speed air stream;
(d) passing a stream of said particles near an electrical conductor;
(e) charging said stream of particles by imparting an electrical charge to said electrical conductor; and
(f) depositing said charged stream of particles over the crops.

3. The process according to claim 2, wherein said charged conductor is arcuate.

4. The process according to claim 2, wherein said charged stream of particles is slowed with a cross-jet of high speed air before being deposited over the crops.

5. The process according to claim 2, wherein said charged stream of particles are deposited over said crops by a nozzle.

6. The process according to claim 2, wherein said charged conductor is of a generally annular shape.

7. The process according to claim 2, wherein said stream of particles is charged by passing it through said annular charged conductor.

8. The process according to claim 2, wherein said charged arcuate conductor has a charge of between 4,000 and 20,000 volts.

9. The process according to claim 2, wherein the air speed of said high speed air through said nozzle is between 100 and 500 miles per hour.

10. The process according to claim 2, further comprising providing a plenum chamber to regulate the flow of said high speed air stream before said high speed air stream reaches said solution.

11. A process for row crop spraying of charged atomized solutions over crops, said process comprising the steps of:

(a) providing a high speed air stream;
(b) providing a solution which is to be applied to the crops;
(c) atomizing said solution by sheering said solution into particles with said high speed air stream;
(d) passing a stream of said particles near an arcuate electrical conductor;
(e) charging said stream of particles by imparting an electrical charge to said arcuate conductor;
(f) slowing said charged stream of particles with a cross-jet of high speed air; and
(g) depositing said charged stream of particles over the crops.

12. An electrostatic row-crop sprayer comprising:

(a) a frame section;
(b) an air moving means for producing high speed air;
(c) a solution storage means;
(d) at least one nozzle comprising:
  (i) a means for atomizing a solution;
  (ii) a charged arcuate conductor for charging said atomized solutions;
  (iii) a means for passing said atomized solution near said arcuate conductor;

(iv) at least one means for directing a high speed air stream into said charged atomized solution to slow the speed of said solution; and
(v) a means for directing said charged atomized solution over the crops.
(e) a means for transporting solution from said solution storage means to said nozzle;
(f) a means for transferring said high speed air from said air moving means to said nozzle;
(g) a current producing means;
(h) a means for transporting current from said current producing means to said arcuate conductor of said nozzle; and
(i) at least one secondary frame section hingably attached to said frame section which extends during use so as to allow greater crop coverage and retracts to a position adjacent to said frame section for transportation and storage.

13. An electrostatic row crop sprayer comprising:
(a) a frame section;
(b) an air moving means for producing high speed air;
(c) a solution storage means;
(d) at least one nozzle comprising:
(i) a means for atomizing a solution;
(ii) a charged arcuate conductor for charging said atomized solution;
(iii) a means for passing said atomized solution near said arcuate conductor;
(iv) at least one means for directing a high speed air stream into said charged atomized solution to slow the speed of said solution; and
(v) a means for directing said charged atomized solution over the crops;
(e) a series of hoses connected from said air moving means to a plenum chamber and from said plenum chamber to said nozzle;
(f) a means for transferring said high speed air from said series of hoses to said nozzle;
(g) a current producing means; and
(h) a means for transporting current from said current producing means to said arcuate conductor of said nozzle.

14. An electrostatic row-crop sprayer comprising:
(a) a frame section;
(b) an air moving means for producing high speed air;
(c) a solution storage means;
(d) at least one nozzle comprising:
(i) a means for atomizing a solution;
(ii) a charged arcuate conductor for charging said atomized solutions;
(iii) a means for passing said atomized solution near said arcuate conductor;
(iv) at least one means for directing a high speed air stream into said charged atomized solution to slow the speed of said solution; and
(v) a means for directing said charged atomized solution over the crops;
(e) a means for transporting solution from said solution storage means to said nozzle;
(f) a means for transferring said high speed air from said air moving means to said nozzle;
(g) a current producing means;
(h) a means for transporting current from said current producing means to said arcuate conductor of said nozzle; and
(i) at least one extension arm depending from said frame section, which allows said nozzle to be placed closer to the crops during spraying.

15. The electrostatic row crop sprayer as defined in claim 14, wherein said extension arm is hingably attached to said frame section to allow said extension arm to pivot upward to clear obstacles in its path.

16. The electrostatic row crop sprayer as defined in claim 14, further comprising a shielding means attached to said extension arm which protects said nozzle during use of the sprayer.

17. A row crop spray nozzle for spraying a charged atomized solution over crops comprising:
(a) a high speed air tube having a solution inlet;
(b) means for atomizing the solution by passing a first high speed air stream through said high speed air tube at a speed sufficient to shear the solution entering said high speed air tube with said first high speed air stream
(c) a charged conductor for charging said atomized solution positioned within sufficient proximity to said atomized solution to impart an electrical charge on said atomized solution;
(d) means for directing a second high speed air stream into said charged atomized solution to slow the speed of said charged atomized solution; and
(e) means for directing said charged atomized solution over the crops.

18. A spray nozzle as defined in claim 17, wherein the housing of the spray nozzle is constructed of cured thermoplastic resin.

19. A spray nozzle as defined in claim 17, wherein said atomizing means is a venturi tube forming a part of said high speed air tube.

20. A spray nozzle as defined in claim 17, wherein said solution inlet enters said high speed air tube through said venturi tube.

21. A spray nozzle as defined in claim 17, wherein said charged conductor is of a generally annular shape.

22. A spray nozzle as defined in claim 21, wherein said atomized solution is passed through said charged annular conductor before deposition upon the crops.

23. A spray nozzle as defined in claim 18, wherein said charged conductor, is molded into said thermoplastic housing.

24. A spray nozzle as defined in claim 20, wherein said solution inlet opens into said venturi tube at an angle not more than 90° to the direction of air flow through the barrel.

25. A spray nozzle as defined in claim 17, wherein said means for directing said second high speed air stream into said charged atomized solution comprises a pair of fanning jets positioned on either side of said high speed air tube and angled to slow said charged atomized solution as said charged atomized solution exits said high speed air tube.

* * * * *